US005513449A

United States Patent [19]

Gramola

[11] Patent Number: 5,513,449

[45] Date of Patent: May 7, 1996

[54] CHEERLEADER SHOE

[75] Inventor: Gianfranco Gramola, Venezia-Mestre, Italy

[73] Assignee: Kaepa, Inc., San Antonio, Tex.

[21] Appl. No.: 279,707

[22] Filed: Jul. 25, 1994

Related U.S. Application Data

[63] Continuation of Ser. No. 118,099, Sep. 8, 1993, abandoned, which is a continuation of Ser. No. 831,436, Feb. 3, 1992, abandoned.

[51] Int. Cl.[6] ..... A43B 5/00

[52] U.S. Cl. ..... 36/114; 36/103

[58] Field of Search ..... 36/113, 114, 1, 36/103, 25 R, 8.3, 31, 59 R, 59 C

[56] References Cited

U.S. PATENT DOCUMENTS

| | | | |
|---|---|---|---|
| 2,701,925 | 2/1955 | Luhr | 36/113 |
| 4,186,502 | 2/1980 | Foster | 36/1 |
| 4,348,821 | 9/1982 | Daswick | 36/103 |
| 4,399,621 | 8/1983 | Dassler | 36/129 |
| 4,439,936 | 4/1984 | Clarke et al. | 36/25 R |
| 4,546,559 | 10/1985 | Dassler | 36/25 R |
| 4,557,059 | 12/1985 | Misevich et al. | 36/25 R |
| 4,578,883 | 4/1986 | Dassler | 36/25 R |
| 4,766,681 | 8/1988 | O'Rourke et al. | 36/114 |
| 5,033,209 | 7/1991 | Bathurst et al. | 36/113 |
| 5,212,878 | 5/1993 | Burke et al. | 36/103 |
| 5,280,680 | 1/1994 | Burke et al. | 36/114 |

*Primary Examiner*—Thomas P. Hilliard
*Attorney, Agent, or Firm*—Testa, Hurwitz & Thibeault

[57] ABSTRACT

This cheerleader shoe (10) includes an upper (12) and a sole (14) the sole having a front portion (16), a heel porition (18) and an intermediate instep area (20). The instep area (20) includes an outside portion (22) and inside portion (24) and a connecting bottom portion (26). The outside portion (22) of the instep area (20) and the shoe heel (18) finger-receiving grooves (20,32), facilitating the holding of the shoe by a helper during the performance of cheerleader routines. The instep bottom portion (26) and inside portion (24) are molded to form a concave face (34) having ribs (36) to facilitate the seating of the instep area (20) by the shoulder of the cheerleader helper.

3 Claims, 3 Drawing Sheets

CHEERLEADER SHOE

This is a continuation of application (s) Ser. No. 08/118,099 filed on Sep. 8, 1993, now abandoned, which is a continuation of Ser. No. 07/831,436 filed Feb. 3, 1992, now abandoned.

BACKGROUND AND SUMMARY OF THE INVENTION

This invention relates generally to athletic shoes and particularly to a shoe for cheerleaders having a sole formed to facilitate holding the shoe and improving the comfort of the cheerleader helper.

During the performance of cheerleader routines and stunts it is often necessary for a female cheerleader to be held aloft by a helper, usually a male cheerleader, who holds the foot of the female cheerleader so that the shoe sits on the palm of the hand of the helper.

In general, the structure of the sole is not conducive to a comfortable handhold and accordingly it is an object of this invention to provide a shoe sole which is formed to facilitate the holding of the shoe.

It is also common during the performance of cheerleader routines for the cheerleader to be supported by the shoulders of the helper in the vicinity of the neck of the helper. It is another object of this invention to provide an improved arcuate portion of the shoe instep to make this shoulder support more comfortable for the helper and provide a better grip for the cheerleader during shoulder-standing stunts. The arcuate portion, in addition, provides increased holding capability for the handhold of the helper in the ball of the thumb area during other routines.

This improved cheerleader shoe includes an upper and a sole portion, the sole including a front portion, an instep area and a heel portion, the instep area including an outside portion, an inside portion and a connecting bottom portion, and said outside portion including groove means providing at least one finger-receiving groove to facilitate the holding of the shoe by a cheerleader helper during the performance of cheerleader routines.

It is an aspect of the invention that a plurality of finger-receiving grooves are provided in the instep outside portion, and in one aspect of the invention four grooves are provided.

It is another aspect of the invention that the heel portion includes a rear area including at least one finger-receiving groove to further facilitate the holding of the shoe.

Still another aspect of the invention is that the instep area bottom portion and inside portion are molded to form an arcuate face having a configuration to facilitate comfortably receiving the said instep portion on the shoulder of a cheerleader helper during performance of cheerleader shoulder-standing routines and additionally facilitates the handhold on the inside of the shoe during other routines so that the handhold is more secure.

It is yet another aspect of the invention that the arcuate face includes includes a plurality of ribs providing gripping means so that the grip on the shoulder, and also the handhold on the inside of the shoe are enhanced.

It is an aspect of this invention to provide an improved cheerleader shoe which is simple and inexpensive to manufacture and is effective for its intended use.

DESCRIPTION OF THE PREFERRED EMBODIMENT

Figure 1:
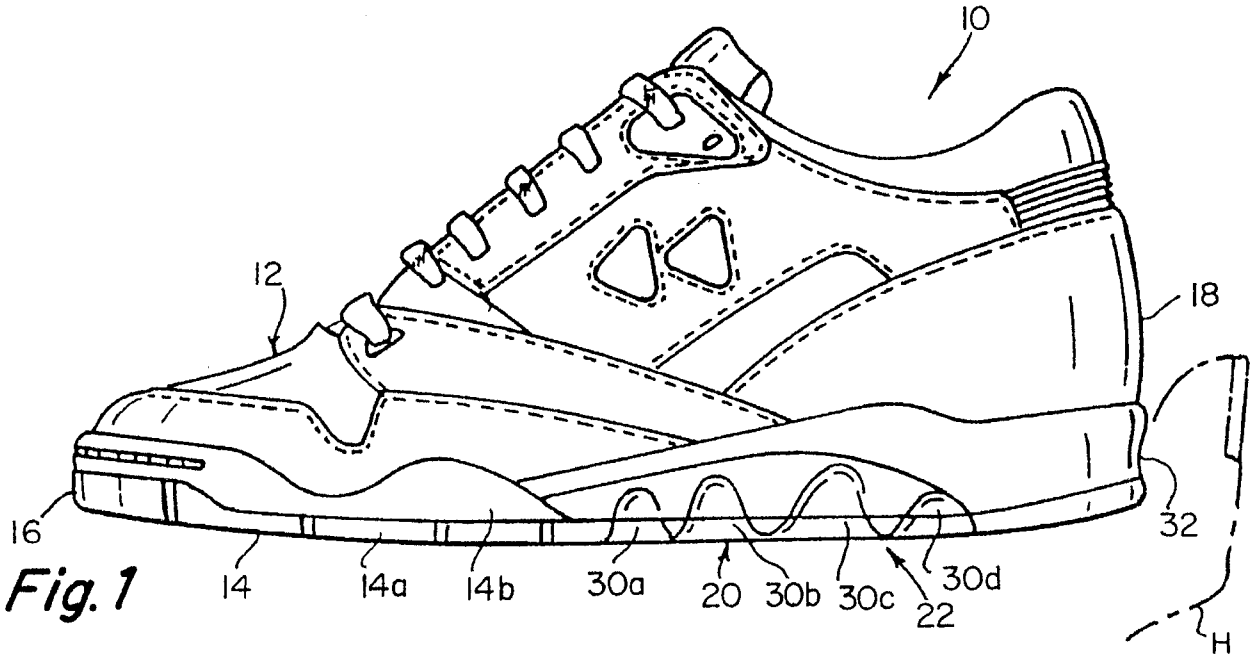
FIG. 1 is an elevational view of the outside of a left shoe.
Figure 2:
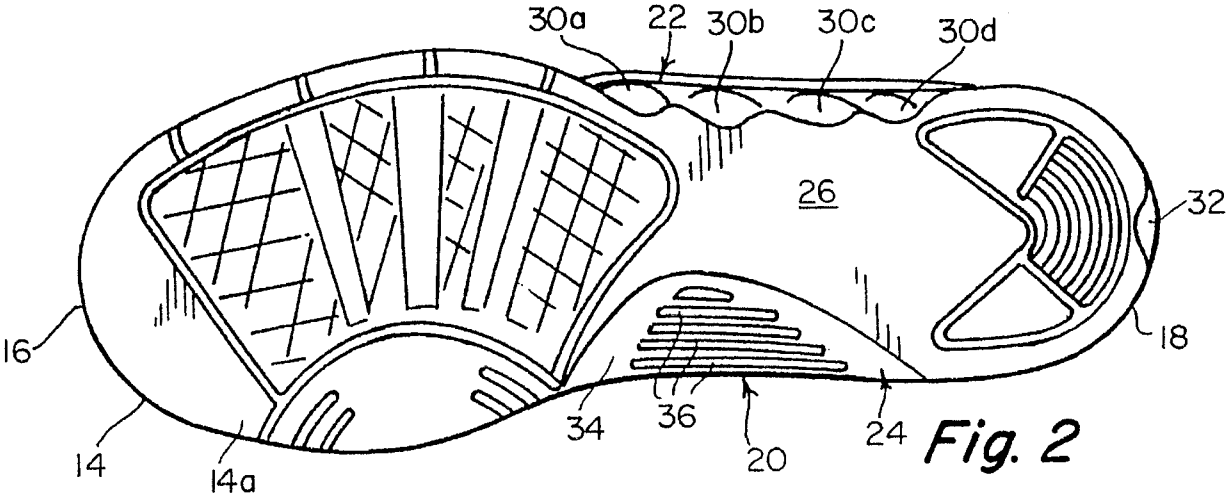
FIG. 2 is a plan view of the bottom of said shoe.
Figure 3:
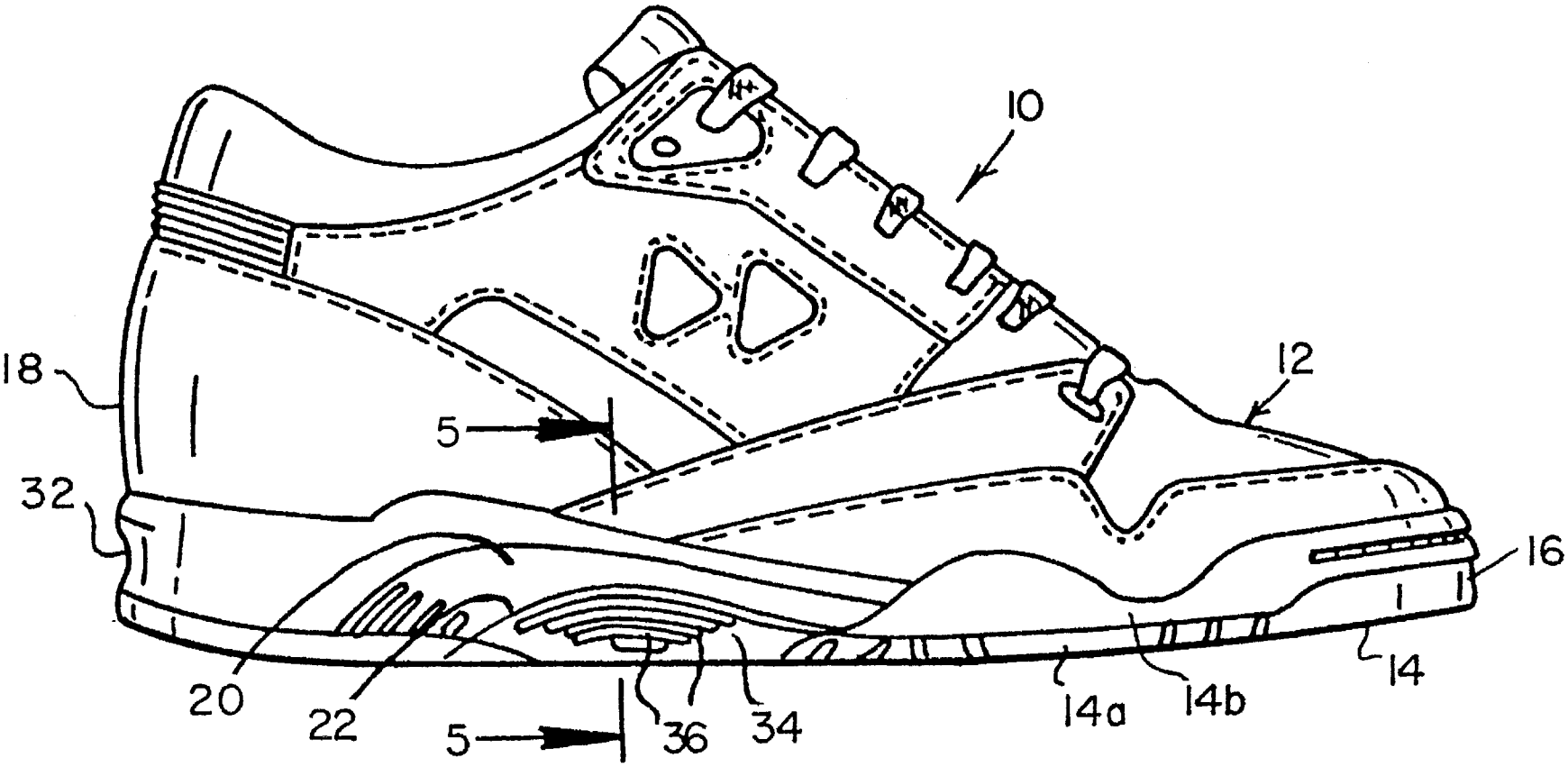
FIG. 3 is an elevational view of the inside of said shoe.

Referring now by reference numerals to the drawing and first to FIGS. 1–3 it will be understood that the cheerleader shoe 10 illustrated is an athletic shoe for the left foot having an upper 12 and a sole 14. Both shoes are provided with the invention and accordingly only the left shoe will be described.

The upper 12 is generally conventional and forms no part of the invention and need not be described. The sole 14, which includes an outsole portion 14*a* and an integrally molded midsole portion 14*b*, extends the full length of the shoe and includes a front portion 16, a heel portion 18 and an intermediate portion disposed between said front and heel portions and generally defining an instep area 20.

The instep area 20 and the rear of the heel are molded to facilitate the performance of cheerleader routines by improving the handhold and shoulder seating capabilities of the shoe as will now be described.

Figure 4:
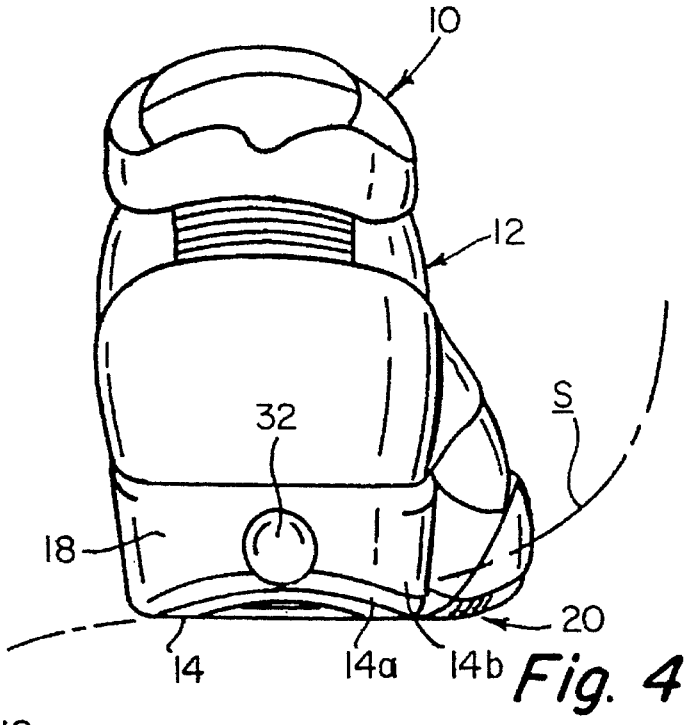
FIG. 4 is an end view of the heel of said shoe.
Figure 5:
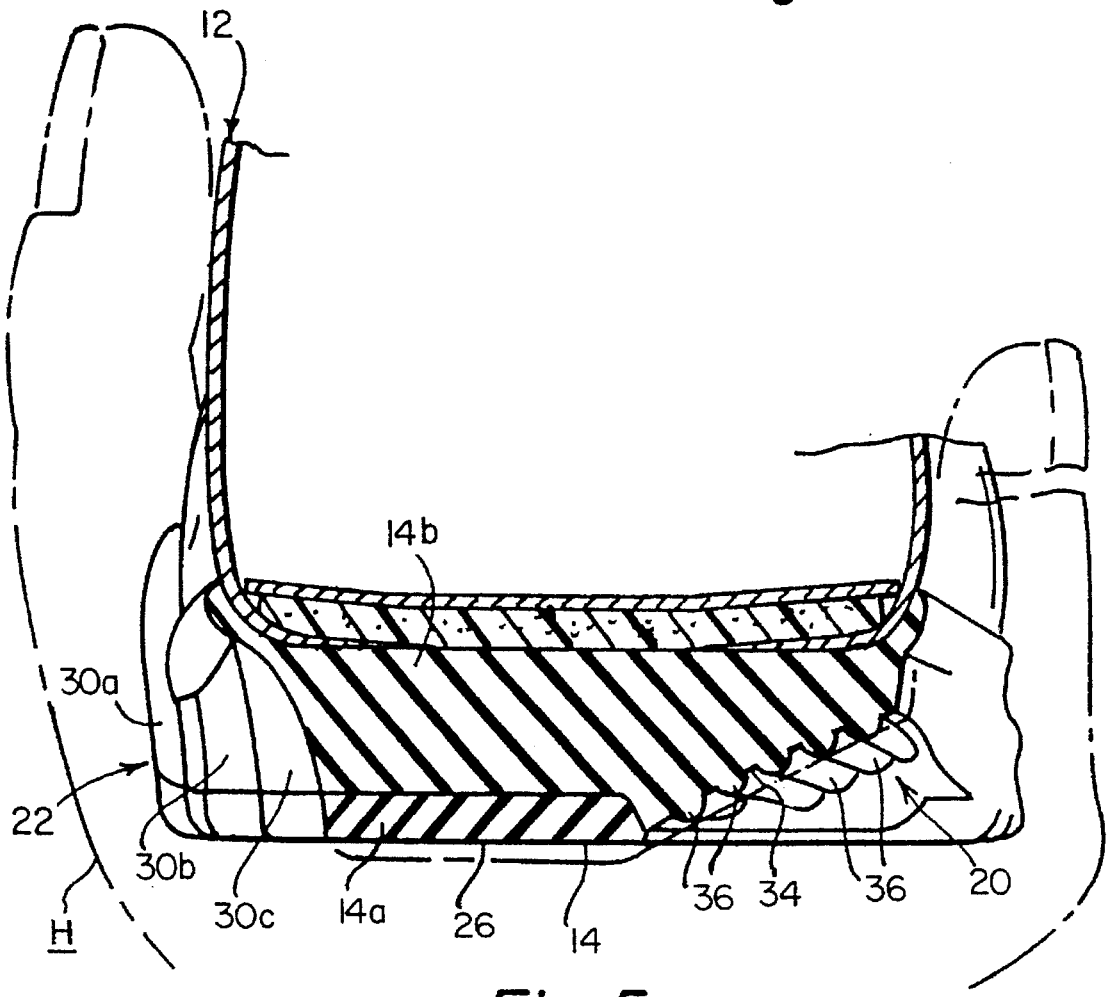
FIG. 5 is an enlarged fragmentary cross-section taken on line 5—5 of FIG. 3.

The instep area 20 includes an outside portion 22, an inside portion 24 and a connecting bottom portion 26. As best shown in FIGS. 1,2 and 5 the outside portion 22 includes groove means providing at least one and, in the embodiment shown, a plurality of contoured finger-receiving tapered grooves or relatively deep indentations, 30*a*, 30*b*, 30*c* and 30*d*, said grooves being closed at the top and having a relatively wide opening at the bottom. The grooves 30 and 32 in the preferred embodiment extend not only into the relatively thin outsole but also well into the midsole. The grooves 30 are four in number in the embodiment shown, to facilitate the holding of the shoe 10 by the hand M of a cheerleader helper during the performance of cheerleader routines. The shoe heel portion as shown in FIG. 4, portion 18, in the preferred embodiment, likewise includes at least one contoured finger-receiving groove or deep indentation 32 to further facilitate the holding of the shoe 10.

As best shown in FIGS. 2, 3, and 5 the instep area bottom portion 26 and inside portion 24 are molded to form an arcuate face 34 having a concave or scalloped configuration and arcuate gripping means in the form of a plurality of curved ribs 36 to facilitate receiving said instep area 20 on the shoulder of a cheerleader helper during the performance of cheerleader routines and minimize discomfort of the pressure of the cheerleader's foot on the helper.

It will be understood, as shown in FIG. 5, that the finger-receiving grooves need not be custom formed to an exact fit of the inside of the fingers, usually the first segment of the fingers adjacent the palm of the hand, of a particular cheerleader helper but rather are contour-configurated so that the hand of any helper is more comfortable in holding and gripping the shoe such that the edge of the shoe sole does not cut into the hand which is holding the shoe. Similarly, the concave portion of the instep area 20 is contour-configurated in a general, rather than a specific manner, to facilitate the receiving of the instep area 20 on the shoulder S of the cheerleader helper at the curve of the neck as shown in FIG. 4 and lessen the discomfort and possible resulting soreness of said shoulder. In addition, the concave portion 34, which is quite deep and extends well into the midsole area 14*b* as well as the outsole 14*a*, assists in providing improved gripping for the hand of the helper on the inside of the shoe particular in view of the ribs 36.

During the performance of various cheerleader routines the provision of the grooves on the outside of the instep area and rear of the heel are intended to facilitate the holding of the shoe by a cheerleader helper, usually another cheerleader, by enhancing the ability of the hand of the helper to hold the shoe firmly yet permit some flexibility for various positions of the hand relative to the shoe. The distribution of the grooves 30 and 32 allows for the shoe to be seated on or above the palm of the hand of the helper and for the lower segments of four fingers to be received by the hand of the helper, including the index finger, with the thumb holding the inside sole and inside upper of the shoe, or, alternatively, for three fingers to be received by selected grooves with the rear groove providing a suitable holding position for a corresponding segment of the index finger. In some positions the heel groove might receive the thumb of the helper. Similarly, it will be understood that during the performance of other routines the shoe will rest on the shoulder of the helper, also usually another cheerleader, at the curve of the neck of the helper. The scalloped form of the arcuate face 34 of the instep 20 at this location improves the comfort of the helper bearer and the ribs 36 improve the gripping ability of the instep.

Although the cheerleader shoe has been described by making particularized reference to preferred structural arrangements of parts, the details of description are not to be understood as restrictive, numerous variants being possible within the principles disclosed and within the fair scope of the claims hereunto appended.

I claim as my invention:

1. A pair of athletic shoes for cheerleaders, each shoe comprising:

(a) an upper and a sole including an outsole and a midsole, (b) the sole including a front portion, an instep arch area, a heel portion, and a peripheral edge.

(c) the arch area including an upwardly extending outside lateral portion, an upwardly extending inside portion, and a bottom portion connecting the upwardly extending lateral and inside portions along the peripheral edge, (d) the heel portion including an upwardly extending rear portion, (e) the bottom portion and the upwardly extending inside portion forming an arcuate face extending into the midsole and having a configuration which facilitates receipt of the arcuate face on a shoulder of a cheerleader helper during a performance of shoulder-standing cheerleader routines and additionally facilitates a hand hold on the inside portion during other cheerleader routines so that the hand hold is more secure, (f) the upwardly extending lateral portion of the arch area including more than two first contoured finger-receiving grooves, each of the first grooves extending into the midsole and being formed to fit an inside of a finger of the cheerleader helper to facilitate holding of each of the shoes by the cheerleader helper during performance of cheerleader routines, the first grooves being collectively oriented to receive a like number of adjacent fingers and the peripheral edge along the lateral portion of the arch area being smoothly scalloped by the first grooves to prevent cutting into the adjacent fingers when the shoe is held in a hand hold, and (g) the upwardly extending rear portion including a second contoured finger-receiving groove which is formed to fit the inside of one of the fingers, or an inside of a thumb, of the cheerleader helper to facilitate further the holding of each of the shoes by the cheerleader helper during performance of cheerleader routines.

2. A pair of athletic shoes as defined in claim 1 wherein the arcuate face of each shoe includes a plurality of ribs which provide enhanced grip on the shoulder of the cheerleader helper and which provide improved grip for the hand of the cheerleader helper.

3. A pair of athletic shoes as defined in claim 2 wherein the ribs of each shoe are generally longitudinally aligned with the front and heel portions of the shoe.

* * * * *